US007407732B2

(12) United States Patent
Ogawa et al.

(10) Patent No.: US 7,407,732 B2
(45) Date of Patent: Aug. 5, 2008

(54) ELECTROPHOTOGRAPHIC TONER

(75) Inventors: Satoshi Ogawa, Nara (JP); Masahiko Kubo, Nara (JP); Tadayuki Sawai, Nara (JP); Kouji Kida, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/465,569

(22) Filed: Jun. 20, 2003

(65) Prior Publication Data

US 2003/0235772 A1 Dec. 25, 2003

(30) Foreign Application Priority Data

Jun. 21, 2002 (JP) ..... P2002-182028

(51) Int. Cl.
*G03G 9/087* (2006.01)

(52) U.S. Cl. ..... 430/108.4; 430/108.1; 430/108.8; 430/109.4

(58) Field of Classification Search ..... 430/109.4, 430/108.1, 108.4, 108.8, 107.1
See application file for complete search history.

(56) References Cited

U.S. PATENT DOCUMENTS

| | | | | |
|---|---|---|---|---|
| 5,578,409 | A * | 11/1996 | Kotaki et al. | 430/108.8 |
| 5,614,347 | A * | 3/1997 | Aoki et al. | 430/108.1 |
| 5,827,631 | A * | 10/1998 | Yoshihara et al. | 430/108.3 |
| 6,007,958 | A * | 12/1999 | Ito et al. | 430/109.4 |
| 6,203,958 | B1 * | 3/2001 | Oya et al. | 430/109.4 |
| 6,203,959 | B1 * | 3/2001 | Tanikawa et al. | 430/108.8 |
| 6,333,132 | B1 * | 12/2001 | Tomura | 430/108.7 |
| 6,356,729 | B1 * | 3/2002 | Sasaki et al. | 399/258 |
| 6,458,499 | B1 * | 10/2002 | Onuma et al. | 430/108.4 |
| 2001/0051309 | A1 * | 12/2001 | Nagahama et al. | 430/108.23 |
| 2002/0072005 | A1 * | 6/2002 | Kohtaki et al. | 430/108.21 |

FOREIGN PATENT DOCUMENTS

| | | | |
|---|---|---|---|
| JP | 3-50560 | A | 3/1991 |
| JP | 8-106173 | A | 4/1996 |
| JP | 9-179342 | A | 7/1997 |
| JP | 2000-338707 | A | 12/2000 |
| JP | 2002-072538 | | 3/2002 |
| JP | 2002-318471 | * | 10/2002 |

OTHER PUBLICATIONS

Japanese Patent Office Machine-Assisted Translation of JP 2000-338 707 (pub. Dec. 2000).*
USPTO English-language translation of JP 2000-338707 (pub. Dec. 2000).*
*Kirk- Othmer Encyclopedia of Chemical Technology*, 4th edition, vol. 25, John Wiley & Sons, Inc., NY (1998), p. 625.*
Japanese Patent Office machine-assisted translation of JP 2002-318471 (pub. Oct. 2002).*
English Abstract of JP 2002-072538, published Mar. 12, 2002, Hitoshi et al, "Electrostatic Latent Image Developing Toner".

* cited by examiner

*Primary Examiner*—Janis L Dote
(74) *Attorney, Agent, or Firm*—Nixon & Vanderhye P.C.

(57) ABSTRACT

An object of the invention is to provide a black toner that can satisfy further the requirement for low energy, high-speed and high performance, a color toner that can be used in an image forming apparatus provided with an oil-less fixation device, and a color toner including the black toner and the color toner. For the black toner, a polyester resin having an acid value of 7 to 20 mgKOH/g is used as the binding resin, and a carboxylic acid-modified paraffin wax having an acid value of 4 to 30 mgKOH/g is used as the wax. For the color toner, polyester resin having an acid value of 7 to 20 mgKOH/g is used as the binding resin, and a carboxylic acid-modified paraffin wax having an acid value of 6 to 25 mgKOH/g is used as the wax.

7 Claims, 1 Drawing Sheet

ELECTROPHOTOGRAPHIC TONER

BACKGROUND OF THE INVENTION

1. Field of the Invention

The present invention relates to an electrophotographic toner. More specifically, the invention relates to a black toner for black and white printing and an electrophotographic toner for full color image formation used in an electrophotographic image forming apparatus such as an electrostatic copier or a laser printer.

2. Description of the Related Art

In recent years, an electrophotographic black-and-white forming apparatus has been used widely. Images are formed in an electrophotographic black-and-white forming apparatus by the processes of charging, exposure, development, transfer and fixation. First, in the charging process, the surface of an insulating photoreceptor is uniformly charged. In the exposure process, the surface of the photoreceptor is irradiated with light corresponding to image information so that a latent electrostatic image is formed thereon. In the development process, a black toner is adhered selectively to this latent electrostatic image so that a toner image is formed on the surface of the photoreceptor. Then, in the transfer process, the toner image is transferred onto a transfer sheet by electric force. In the last process of fixation, the toner image transferred onto the transfer sheet is melted by heat so as to be fixed on the transfer sheet.

In this black and white forming apparatus, low energy (reduction in power consumption), high-speed of processing and high performance are required, as this apparatus is increasingly widely spread. With respect to these requirements, it has been proposed to achieve low energy, and high-speed, simplification and stabilization of processing for a fixation device for fixing a toner image in a transfer sheet. In general, as the fixation device, those employing heating rolls are used. The fixation device employing heating rolls includes a fixation roller having a built-in heater and a pressure roller. A transfer sheet is passed between the fixation roller and the pressure roller, and heat and pressure are applied to the transfer sheet so that a toner image is melted and fixed.

In such a fixation device, a black toner having a property of low temperature fixation that allows satisfactory fixation even at a low temperature and a wide fixation temperature region have been under development for low energy, and high-speed, simplification and stabilization of processing. Among these, regarding the property of low temperature fixation, there is an attempt to use a low molecular weight binding resin. In order to achieve a wide fixation temperature region, there is an attempt to use a wax that is melted out at a low temperature and prevents a toner from adhering to the fixation roller by covering the surface of the fixation roller.

However, when an image is formed by a black toner containing a low molecular weight binding resin, the high temperature offset phenomenon in which a toner adheres to a fixation roller during heat melting tends to occur readily. This is because in such a toner, cohesion between toner particles is reduced so that the toner layers are separated. Therefore, there is a demand for development of a good black toner that hardly allows the high temperature offset phenomenon.

Recently, the multicolor electrophotographic technique has been developed rapidly, and thus full color image forming apparatuses have been developed. The market of the full color image forming apparatuses has been enlarged with the wide spread of black and white image forming apparatuses. In general, for reproduction of color in the full color image forming apparatuses, a color toner having three colors of yellow (Y), magenta (M), cyan (C), which are the three primary colors of subtractive mixture of colors, or a color toner having four colors of these three colors and black (K) is used. For procedure of reproduction of colors, with respect to each color of C, M, Y and K, the processes of charging, exposure, development and transfer of the image formation processes are repeated so that toner images formed of color toners of a plurality of colors are superimposed and formed on a transfer sheet. Then, in the last process of fixation, the superimposed toner images are melted so as to be fixed on the transfer sheet. By this procedure, the superimposed toner images are mixed by being melted, so that colors are reproduced based on the principle of the subtractive mixture of colors.

Thus, in the full color image forming apparatus, the processes from charging to transfer for each color are repeated, and toner images formed of color toners of a plurality of colors are superimposed on a transfer sheet, and therefore the melting characteristics of color toners with respect to the transfer sheet are very important. That is to say, the color toners should be melted to an extent that the boundaries between the toner particles are eliminated so that color reproduction is not prevented by diffused reflection of light by the fixed toner particles and should have a wide color reproduction range in which transparency can be provided. In addition, appropriate gloss and luster are required.

For the full color image forming apparatus, in a fixation device for fixing a toner image made of a color toner, a fixation roller made of a material having good surface releasing properties is used, and a large amount of oil is applied to the surface of the fixation roller in order to improve the releasing properties further. In general, a large amount of oil is applied to the fixation roller for the following reasons.

As described above, the melting characteristics of a color toner are important, so that the color toner is formed of a material having a lower viscosity and a larger thermal melting properties than those of a black toner for a black and white image forming apparatus. However, when a binding resin having a low viscosity is used for a toner, the cohesion of the toner is poor, so that the toner layers are separated, and the offset phenomenon in which the toner partially adheres to the fixation roller tends to occur readily, which results in non-uniformity in an image. In order to reduce the non-uniformity in an image, a large amount of oil is applied to the fixation roller.

However, when a large amount of oil is applied to the fixation roller, a transfer sheet may be soiled with oil, and the cost may increase. Furthermore, a space in which oil is stored is required, so that another problem is caused in that the structure of the color image forming apparatus becomes complicated or large.

In order to solve the above problems, a so-called "oil-less toner" is proposed. An "Oil-less toner" refer to a toner in which the occurrence of the high temperature offset phenomenon is reduced by a certain amount of wax that oozes from the toner particles and penetrates between the toner and the fixation roller during melting for fixation. With this oil-less toner, it is attempted to put into practice an oil-less fixation device that does not apply oil to the fixation roller, and thus the problems of soiling a transfer sheet with oil, increasing the cost and resulting in a complicated and large structure are being solved.

However, it is for a black and white image forming apparatus that it is attempted to put the oil-less fixation device into practice, and there is a problem in using the oil-less fixation device for a full color image forming apparatus. This is because when fixing color toners having a lower toner cohesion than that of the black toner with the oil-less fixation device, the offset phenomenon occurs and thus non-uniformity in the images occurs. Therefore, in order to fix color toners with the oil-less fixation device, it is necessary to adjust the amount of the wax that oozes out so that the effect of oozing the wax is sufficiently exhibited.

The amount of the wax that oozes from the toner depends on the compatibility between the binding resin and the wax contained in the toner. When the compatibility is too good, the binding resin and the wax are integrated, which makes it difficult that the wax oozes out. On the other hand, when the compatibility is poor, the wax is dispersed poorly in the toner particles so that the wax is present in the form of a large lump non-uniformly in the toner particles or on the surface thereof. This may deteriorate the charging characteristics, which are the characteristics of the toner, or generate filming to the photoreceptor or the carrier. Furthermore, during melting for fixation, because of this large lump, low viscous wax layers are generated in the toner and separation occurs in the toner layer, and thus the high temperature offset phenomenon tends to occur easily.

The techniques for improving the fixation properties of a toner are disclosed in Japanese Unexamined Patent Publications JP-A 3-50560 (1991), JP-A 8-106173 (1996), JP-A 9-179342 (1997) and JP-A 2000-338707 (2000).

JP-A 3-50560 discloses a developing toner for an electrostatically charged image containing a paraffin wax that is modified with carboxylic acid or an acid anhydride thereof.

JP-A 8-106173 discloses a developing agent (toner) containing a binder resin (binding resin) having an acid value of 5 to 50 mgKOH/g made of a polyester resin or a mixture of a polyester resin and styrene-acrylic resin and two kinds of waxes having different melting points.

JP-A 9-179342 discloses an electrophotographic toner containing a natural gas7based Fischer-Tropsch wax having an acid value of 1 to 5 mgKOH/g and a polyester resin having an acid value of 1 to 5 mgKOH/g.

JP-A 2000-338707 discloses a developing toner for an electrostatically charged image containing an alcohol-based paraffin wax including a saturated hydrocarbon having 20 to 60 carbon atoms, having a melting point of 65 to 110° C., an acid value of 5 to 25 mgKOH/g, a saponification value of 20 to 50 mgKOH/g, and a hydroxyl value of 50 to 120 mgKOH/g.

As described above, regarding black toners, it is a challenge to develop a black toner that can satisfy the requirements of low energy, high-speed and high performance to a higher extent for an electrophotographic black-and-white image forming apparatus. Furthermore, regarding color toners, it is a challenge to develop a color toner that can be used in a full-color image forming apparatus provided with an oil-less fixation device.

That is, regarding black toners, it is necessary to develop a black toner having good fixation characteristics such as the property of low temperature fixation and a wide fixation temperature region. Regarding color toners, it is necessary to develop a color toner that has good fixation characteristics, can exhibit a good effect of oozing wax and has high transparency and good gloss properties.

In the developing toner for electrostatically charged images disclosed in JP-A 3-50560, a carboxylic acid-modified paraffin wax having better fixation strength and releasing properties than those of conventionally used polyethylene is used. However, the property of low temperature fixation or the effect of oozing the wax are not considered.

In the toner disclosed in JP-A 8-106173, the compatibility between the binding resin and the wax and the effect of oozing the wax are considered, and high speed fixation is aimed at. However, it is not considered to ensure a wide fixation temperature region.

In the electrophotographic toner disclosed in JP-A 9-179342, it is attempted to improve the property of low temperature fixation, the fixation strength and the compatibility with the binding resin by providing the Fischer-Tropsch wax with a polar group. However, it is not considered to ensure a wide fixation temperature region or the effect of oozing the wax.

In the developing toner for electrostatically charged images disclosed in JP-A 2000-338707, an appropriate compatibility with the binding resin and a wide fixation temperature region are ensured by allowing the toner to contain a predetermined alcohol based wax. However, the effect of oozing the wax is not considered.

SUMMARY OF THE INVENTION

An object of the invention is to provide a black toner having good fixation characteristics such as the property of low temperature fixation and a wide fixation temperature region to satisfy the requirement for low energy or the like. Another object of the invention is to provide a color toner that has good fixation characteristics, can exhibit a good effect of oozing the wax, and has high transparency and good gloss properties.

The invention provides an electrophotographic toner containing a binding resin, a wax and a coloring agent, wherein the binding resin is made of a polyester resin having an acid value of 7 to 20 mgKOH/g, and the wax is made of a carboxylic acid-modified paraffin wax having an acid value of 4 to 30 mgKOH/g.

According to the invention, a polyester resin having an acid value of 7 to 20 mgKOH/g is used as the binding resin contained in the electrophotographic toner, and a carboxylic acid-modified paraffin wax having an acid value of 4 to 30 mgKOH/g is used as the wax. The polyester resin has excellent releasing properties, charging properties and pigment dispersibility and excellent preservability at a low molecular weight. Thus, a toner having a property of low temperature fixation can be realized and the requirement for low energy in an electrbphotographic image forming apparatus can be satisfied.

On the other hand, the carboxylic acid-modified paraffin wax is compatible with the polyester resin to an appropriate extent, and the wax starts to ooze from the binding resin at a low temperature. Thus, the adhesion of the wax onto the paper can be enhanced from at a low temperature. Furthermore, during melting for fixation, the wax oozed from the toner penetrates between the toner and the fixation roller and covers the surface of the fixation roller, so that the high temperature offset phenomenon can be prevented from occurring. Thus, a toner having a wide fixation temperature region from a low temperature to a high temperature can be realized.

When the acid value of the polyester resin is smaller than 7 mgKOH/g, the compatibility with the wax becomes poor, so that the charging properties of the toner deteriorates and toner scattering or fogging occurs. Furthermore, filming to the photoreceptor and the carrier occurs. Fogging refers to a phenomenon in which unwanted toner particles adhere to a portion that should be a white space in a formed image. On the other hand, when the acid value of the polyester resin is larger than 20 mgKOH/g, the content of toner particles becomes large, so that the characteristics of the toner are varied significantly with an ambient variation such as a change in humidity or temperature. As a result, a problem is caused in the charging properties, and a stable toner image cannot be maintained.

When the acid value of the carboxylic acid-modified paraffin wax is smaller than 4 mgKOH/g, the compatibility with the binding resin becomes poor, so that the charging properties of the toner deteriorates and toner scattering or fogging occurs. Furthermore, filming to the photoreceptor and the carrier occurs. On the other hand, when the acid value of the carboxylic acid-modified paraffin wax is larger than 30 mgKOH/g, the compatibility with the binding resin is too good, so that the carboxylic acid-modified paraffin wax does not sufficiently ooze during melting for fixation.

From the above, the acid value of the polyester resin is in the range of 7 to 20 mgKOH/g, and the acid value of the carboxylic acid-modified paraffin wax is in the range of 4 to 30 mgKOH/g, in order to optimize the characteristics of both the binding resin and the wax while maintaining the compatibility between the binding resin and the wax. Thus, an electrophotographic toner having a property of low temperature fixation and a wide fixation temperature region and excellent charging properties and preservability can be provided.

Furthermore, the invention provides an electrophotographic toner containing a binding resin, a wax and a coloring agent, wherein the binding resin is made of a polyester resin having an acid value of 7 to 15 mgKOH/g, and the wax is made of a carboxylic acid-modified paraffin wax having an acid value of 6 to 25 mgKOH/g.

According to the invention, a polyester resin having an acid value of 7 to 15 mgKOH/g is used as the binding resin contained in the electrophotographic toner, and a carboxylic acid-modified paraffin wax having an acid value of 6 to 25 mgKOH/g is used as the wax.

The compatibility between the binding resin and the wax and the amount of the oozed wax can be optimized by further limiting the acid value of the polyester resin and the carboxylic acid-modified paraffin wax, so that an electrophotographic toner having a wide fixation temperature region and good charging characteristics can be provided.

The invention provides an electrophotographic toner containing a binding resin, a wax and a coloring agent, wherein the binding resin is made of a polyester resin having an acid value of 5 to 20 mgKOH/g, and the wax is made of an alcohol- modified paraffin wax having an acid value of 2 to 20 mgKOH/g.

According to the invention, a polyester resin having an acid value of 5 to 20 mgKOH/g is used as the binding resin contained in the electrophotographic toner, and an alcohol-modified paraffin wax having an acid value of 2 to 20 mgKOH/g as the wax. The polyester resin has excellent releasing properties, charging properties and pigment dispersibility and excellent preservability at a low molecular weight. Thus, a toner having a property of low temperature fixation can be realized and the requirement for low energy in an electrophotographic image forming apparatus can be satisfied.

On the other hand, the alcohol-modified paraffin wax is compatible with the polyester resin to an appropriate extent, and the wax starts to ooze from the binding resin at a low temperature. Thus, the adhesion of the wax onto the paper can be enhanced from at a low temperature. Furthermore, during melting for fixation, the wax oozed from the toner penetrates between the toner and the fixation roller and covers the surface of the fixation roller, so that the high temperature offset phenomenon can be prevented from occurring. Thus, a toner having a wide fixation temperature region from a low temperature to a high temperature can be realized.

When the acid value of the polyester resin is smaller than 5 mgKOH/g, the compatibility with the wax becomes poor, so that the charging properties of the toner deteriorates and toner scattering or fogging occurs. Furthermore, filming to the photoreceptor and the carrier occurs. On the other hand, when the acid value of the polyester resin is larger than 20 mgKOH/g, the content of toner particles becomes large, so that the characteristics of the toner are varied significantly with an ambient variation such as a change in humidity or temperature. As a result, a problem is caused in the charging properties, and a stable toner image cannot be maintained.

When the acid value of the alcohol-modified paraffin wax is smaller than 2 mgKOH/g, the compatibility with the binding resin becomes poor, so that the charging properties of the toner deteriorates and toner scattering or fogging occurs. On the other hand, when the acid value of the alcohol-modified paraffin wax is larger than 20 mgKOH/g, the compatibility with the binding resin is too good, so that the alcohol-modified paraffin wax does not sufficiently ooze during melting for fixation.

From the above, the acid value of the polyester resin is in the range of 5 to 20 mgKOH/g, and the acid value of the alcohol-modified paraffin wax is in the range of 2 to 20 mgKOH/g, in order to optimize the characteristics of both the binding resin and the wax while maintaining the compatibility between the binding resin and the wax. Thus, an electrophotographic toner having the property of low temperature fixation, a wide fixation temperature region, good fixation characteristics, and excellent charging properties and preservability can be provided.

Furthermore the invention provides an electrophotographic toner containing a binding resin, a wax and a coloring agent, wherein the binding resin is made of a polyester resin having an acid value of 5 to 15 mgKOH/g, and the wax is made of an alcohol-modified paraffin wax having an acid value of 4 to 15 mgKOH/g.

According to the invention, a polyester resin having an acid value of 5 to 15 mgKOH/g is used as the binding resin contained in the electrophotographic toner, and an alcohol-modified paraffin wax having an acid value of 4 to 15 mgKOH/g is used as the wax.

The compatibility between the binding resin and the wax and the amount of the oozed wax can be optimized by further limiting the acid values of the polyester resin and the alcohol-modified paraffin wax, so that an electrophotographic toner having a wide fixation temperature region and good charging characteristics can be provided.

In the invention it is preferable that the penetration of the wax is 5 or less.

According to the invention, a wax having a penetration of 5 or less is used. When the penetration of the wax is larger than 5, the wax is excessively plastic so that the wax plastically deforms during toner flow, which deteriorates the flowability of the toner. When the flowability of the toner is deteriorated, the frictional electrification is varied between the toner particles and uniform charging properties cannot be obtained. Consequently, toner scattering or fogging occurs. In addition, the preservability is also deteriorated. Furthermore, in the production process of the toner, there is a problem of a reduction in the crushing properties. From the above, the penetration of the wax is 5 or less in order to optimize the charging properties, the flowability and the preservability of the toner.

Furthermore, in the invention it is preferable that the penetration of the wax is 3 or less.

According to the invention, a wax having a penetration of 3 or less is used.

Thus, an electrophotographic toner having further optimized charging properties, flowability and preservability can be provided by further limiting the penetration of the wax.

Furthermore, in the invention it is preferable that the DSC peak temperature of the wax is in the range of 75 to 115° C.

According to the invention, a wax having a DSC (Differential Scanning Calorimeter) peak temperature of the wax in the range of 75 to 115° C. is used. When the DSC peak temperature of the wax is lower than 75° C., the preservability is deteriorated. When the DSC peak temperature of the wax is higher than 115° C., it is difficult that the wax oozes and thus the fixation characteristics are deteriorated.

From the above, the DSC peak temperature of the wax is in the range of 75 to 115° C. in order to optimize the fixation characteristics and the preservability of the toner.

Furthermore, in the invention it is preferable that the DSC peak temperature of the wax is in the range of 80 to 110° C.

According to the invention, a wax having a DSC peak temperature of the wax in the range of 80 to 110° C. is used. Thus, an electrophotographic toner having further optimized fixation characteristics and preservability can be provided by further limiting the DSC peak temperature of the wax.

Furthermore, in the invention it is preferable that the melting temperature of the binding resin is 105 to 135° C.

According to the invention, a binding resin having a melting temperature of 105 to 135° C. is used. When the melting temperature of the binding resin is lower than 105° C., the cohesion of the toner during melting is deteriorated, so that the high temperature offset phenomenon in which the toner adheres to the fixation roller occurs. When the melting temperature of the binding resin is higher than 135° C., the toner cannot be fixed at a low temperature so that the requirement for low energy cannot be satisfied.

From the above, the melting temperature of the binding resin is 105 to 135° C. in order to optimize the fixation temperature region.

Furthermore, in the invention it is preferable that the melting temperature of the binding resin is in the range of 110 to 130° C.

According to the invention, a binding resin having a melting temperature in the range of 110 to 130° C. is used.

Thus, an electrophotographic toner having a further optimized fixation temperature region can be provided by further limiting the melting temperature of the binding resin.

Furthermore, in the invention it is preferable that the amount of the wax added is in the range of 1 to 10 parts by weight with respect to 100 parts by weight of the binding resin.

According to the invention, the amount of the wax added is in the range of 1 to 10 parts by weight with respect to 100 parts by weight of the binding resin. When the amount of the wax added is less than 1 part by weight, the effect of the wax in the toner particles cannot be exhibited. When the amount of the wax added is more than 10 parts by weight, the flowability of the toner is deteriorated. Thus, the frictional electrification is varied between the toner particles and uniform charging properties cannot be obtained. Consequently, toner scattering or fogging occurs.

From the above, the amount of the wax added is in the range of 1 to 10 parts by weight in order to optimize the effect of the wax in the toner particles and the charging properties.

Furthermore, in the invention it is preferable that the amount of the wax added is in the range of 1 to 6 parts by weight with respect to 100 parts by weight of the binding resin.

According to the invention, the amount of the wax added is in the range of 1 to 6 parts by weight with respect to 100 parts by weight of the binding resin.

Thus, an electrophotographic toner having further optimized charging properties can be provided by further limiting the amount of the wax added.

The invention provides an electrophotographic toner for full color image formation containing a binding resin, a wax and a coloring agent, wherein the binding resin is made of a polyester resin having an acid value of 7 to 20 mgKOH/g, and the wax is made of a carboxylic acid-modified paraffin wax having an acid value of 6 to 25 mgKOH/g.

According to the invention, a polyester resin having an acid value of 7 to 20 mgKOH/g is used as the binding resin contained in the electrophotographic toner for full color image formation such as a cyan toner, a magenta toner, a yellow toner or a black toner, and a carboxylic acid-modified paraffin wax having an acid value of 6 to 25 mgKOH/g is used as the wax. When the acid value of the carboxylic acid-modified paraffin wax is further limited to 6 to 25 mgKOH/g, the wax can be dispersed uniformly in the toner particles and the amount of the oozed wax cannot be reduced, which provides stability. Thus, the color toner can be fixed sufficiently, and the offset phenomenon is less likely to occur. Therefore, an image forming apparatus provided with an oil-less fixation device can be used with a color toner as well.

From the above, the acid value of the polyester resin is in the range of 7 to 20 mgKOH/g, and the acid value of the carboxylic acid-modified paraffin wax is in the range of 6 to 25 mgKOH/g, in order to optimize the amount of the oozed wax while maintaining the compatibility between the binding resin and the wax. Thus, when the effect of oozing the wax is considered, an image forming apparatus provided with an oil-less fixation device can be used with a color toner as well. Furthermore, when the characteristics of both the binding resin and the wax and the compatibility with the binding resin are considered, an electrophotographic toner for full color image formation having a wide fixation temperature region and excellent charging properties, flowability and preservability can be provided.

Furthermore, the invention provides an electrophotographic toner for full color image formation containing a binding resin, a wax and a coloring agent, wherein the binding resin is made of a polyester resin having an acid value of 7 to 15 mgKOH/g, and the wax is made of a carboxylic acid-modified paraffin wax having an acid value of 6 to 20 mgKOH/g.

According to the invention, a polyester resin having an acid value of 7 to 15 mgKOH/g is used as the binding resin contained in the electrophotographic toner for full color image formation such as a cyan toner, a magenta toner, a yellow toner or a black toner, and a carboxylic acid-modified paraffin wax having an acid value of 6 to 20 mgKOH/g is used as the wax.

Thus, when the acid values of the polyester resin and the carboxylic acid-modified paraffin wax are further limited, the compatibility between the binding resin and the wax and the amount of the oozed wax can be optimized, and an electrophotographic toner for full color image formation having a wide fixation temperature region and good charging properties can be provided.

Furthermore, the invention provides an electrophotographic toner for full color image formation containing a binding resin, a wax and a coloring agent, wherein the binding resin is made of a polyester resin having an acid value of 5 to 20 mgKOH/g, and the wax is made of an alcohol-modified paraffin wax having an acid value of 4 to 15 mgKOH/g.

According to the invention, a polyester resin having an acid value of 5 to 20 mgKOH/g is used as the binding resin contained in the electrophotographic toner for full color image formation such as a cyan toner, a magenta toner, a yellow toner or a black toner, and an alcohol-modified paraffin wax having an acid value of 4 to 15 mgKOH/g is used as the wax. When the acid value of the alcohol-modified paraffin wax is further limited to 4 to 15 mgKOH/g, the wax can be dispersed uniformly in the toner particles and the amount of the oozed wax cannot be reduced, which provides stability. Thus, the color toner can be fixed sufficiently, and the offset phenomenon is less likely to occur. Therefore, an image forming apparatus provided with an oil-less fixation device can be used with a color toner as well.

From the above, the acid value of the polyester resin is in the range of 5 to 20 mgKOH/g, and the acid value of the alcohol-modified paraffin wax is in the range of 4 to 15 mgKOH/g, in order to optimize the amount of the oozed wax while maintaining the compatibility between the binding resin and the wax. Thus, when the effect of oozing the wax is considered, an image forming apparatus provided with an oil-less fixation device can be used with a color toner as well. Furthermore, an electrophotographic toner for full color image formation having good fixation characteristics and a wide fixation temperature region and excellent charging properties, flowability and preservability can be provided.

Furthermore, the invention provides an electrophotographic toner for full color image formation containing a binding resin, a wax and a coloring agent, wherein the binding resin is made of a polyester resin having an acid value of 5 to 15 mgKOH/g, and the wax is made of an alcohol-modified paraffin wax having an acid value of 4 to 13 mgKOH/g.

According to the invention, a polyester resin having an acid value of 5 to 15 mgKOH/g is used as the binding resin contained in the electrophotographic toner for full color image formation such as a cyan toner, a magenta toner, a yellow toner or a black toner, and an alcohol-modified paraffin wax having an acid value of 4 to 13 mgKOH/g is used as the wax.

Thus, when the acid values of the polyester resin and the alcohol-modified paraffin wax are further limited, the compatibility between the binding resin and the wax and the amount of the oozed wax can be optimized, and an electrophotographic toner for full color image formation having a wide fixation temperature region and good charging properties can be provided.

Furthermore, in the invention it is preferable that the penetration of the wax is 3 or less.

According to the invention, a wax having a penetration of 3 or less is used. The color toners have a low melting temperature, and therefore the preservability tends to be low. For this reason, the penetration of the wax is 3 or less in order to prevent the preservability and optimize the charging properties and the flowability.

Furthermore, in the invention it is preferable that the penetration of the wax is 2 or less.

According to the invention, a wax having a penetration of 2 or less is used.

Thus, further optimized charging properties, flowability and preservability can be obtained by further limiting the penetration of the wax.

Furthermore, in the invention it is preferable that the DSC peak temperature of the wax is in the range of 75 to 110° C.

According to the invention, a wax having a DSC peak temperature of the wax in the range of 75 to 110° C. is used. In color toners, when the DSC peak temperature of the wax is higher than 110° C., it is difficult that the wax oozes and thus the fixation characteristics are deteriorated.

From the above, the DSC peak temperature of the wax is in the range of 75 to 110° C. in order to optimize the fixation characteristics and the preservability.

Furthermore, in the invention it is preferable that the DSC peak temperature of the wax is in the range of 75 to 100° C.

According to the invention, a wax having a DSC peak temperature of the wax in the range of 75 to 100° C. is used. Thus, an electrophotographic toner having further optimized fixation characteristics and preservability can be provided by further limiting the DSC peak temperature of the wax.

Furthermore, in the invention it is preferable that the melting temperature of the binding resin is 95 to 125° C.

According to the invention, a binding resin having a melting temperature of 95 to 125° C. is used. In color toners, when the melting temperature of the binding resin is lower than 95° C., the cohesion of the toner during melting is deteriorated, so that the high temperature offset phenomenon in which the toner adheres to the fixation roller occurs. When the melting temperature of the binding resin is higher than 125° C., the toner cannot completely be melted. Thus, the transparency of the toner is poor and the color reproduction is deteriorated. Furthermore, the surface of images can hardly be smooth to an appropriate extent, so that the gloss properties are poor.

From the above, the melting temperature of the binding resin is 95 to 125° C. in order to optimize the fixation temperature region, the transparency and the gloss properties.

Furthermore, in the invention it is preferable that the melting temperature of the binding resin is in the range of 95 to 115° C.

According to the invention, a binding resin having a melting temperature in the range of 95 to 115° C. is used. Thus, a further optimized fixation temperature region, transparency and gloss properties can be obtained by further limiting the melting temperature of the binding resin.

Furthermore, in the invention it is preferable that the amount of the wax added is in the range of 1 to 10 parts by weight with respect to 100 parts by weight of the binding resin.

According to the invention, the amount of the wax added is in the range of 1 to 10 parts by weight with respect to 100 parts by weight of the binding resin. When the amount of the wax added is less than 1 part by weight, the effect of the wax in the toner particles cannot be exhibited. When the amount of the wax added is more than 10 parts by weight, the flowability of the toner is deteriorated. Thus, the frictional electrification is varied between the toner particles and uniform charging properties cannot be obtained. Consequently, toner scattering or fogging occurs.

From the above, the amount of the wax added is in the range of 1 to 10 parts by weight in order to optimize the effect of the wax in the toner particles and the charging properties.

Furthermore, in the invention it is preferable that the amount of the wax added is in the range of 1 to 6 parts by weight with respect to 100 parts by weight of the binding resin.

According to the invention, the amount of the wax added is in the range of 1 to 6 parts by weight with respect to 100 parts by weight of the binding resin.

Thus, further optimized charging properties can be obtained by further limiting the amount of the wax added.

The invention provides an electrophotographic toner for full color image formation comprising:

the electrophotographic black toner according to the above, wherein the coloring agent is for black;

the electrophotographic yellow toner for full color according to the above, wherein the coloring agent is for yellow;

the electrophotographic magenta toner for full color according to the above, wherein the coloring agent is for magenta; and the electrophotographic cyan toner for full color according to the above, wherein the coloring agent is for cyan.

According to the invention, an electrophotographic toner for full color image formation includes the above-described electrophotographic black toner containing a coloring agent for black, the above-described electrophotographic yellow toner containing a coloring agent for yellow, the above-described electrophotographic magenta toner containing a coloring agent for magenta, and the above-described electrophotographic cyan toner containing a coloring agent for cyan.

The black toner and the color toners of the yellow toner, the magenta toner and the cyan toner having the optimized characteristics are used. Thus, a black toner having good fixation characteristics such as the property of low temperature fixation and a wide fixation temperature region and excellent charging properties, flowability and preservability can be provided. In addition, color toners that can be used in an image forming apparatus provided with an oil-less fixation device and are excellent in the property of low temperature fixation, transparency, gloss properties, a wide fixation temperature region, fixation characteristics, flowability and preservability can be provided.

According to the invention, a black toner having good fixation characteristics such as the property of low temperature fixation and a wide fixation temperature region and excellent charging properties, flowability and preservability can be provided, and the requirement for low energy can be satisfied.

According to the invention, color toners in which an appropriate amount of wax oozes and that have fixation characteristics such as the good property of low temperature fixation and a wide fixation temperature region, and excellent transparency, gloss properties, charging properties, flowability and preservability can be provided. The color toner as well can be used in an image forming apparatus provided with an oil-less fixation device.

Furthermore, according to the invention, a color toner comprising the black toner, the yellow toner, the magenta toner and the cyan toner having the optimized characteristics can be used.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
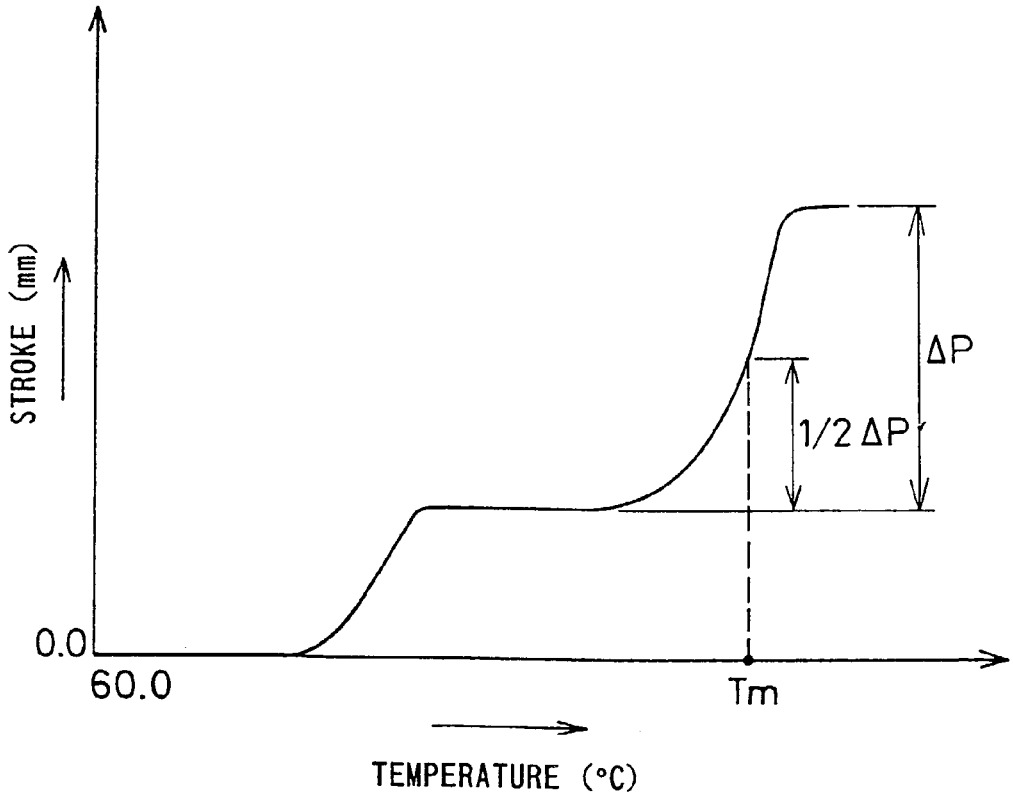
FIG. 1 is a schematic view showing a graph output by a flow tester CFT-500.

Now referring to the drawings, preferred embodiments of the invention are described below.

The electrophotographic toner of the invention contains a binding resin, a wax and a coloring agent. For the binding resin, a polyester resin having excellent release properties and charging properties and pigment dispersibility and having excellent preservability even though having a low molecular weight is used. Thus, the binding resin is a low molecular weight resin, a toner having the property of low temperature fixation can be realized, so that the requirement for low energy can be satisfied.

When the wax contained in the toner is a carboxylic acid-modified paraffin wax, the acid value of the polyester resin is preferably 7 to 20 mgKOH/g, and more preferably 7 to 15 mgKOH/g. This range can optimize the compatibility with the wax and the effect of oozing the wax. When the wax contained in the toner is an alcohol-modified paraffin wax, the acid value of the polyester resin is preferably 5 to 20 mgKOH/g, and more preferably 5 to 15 mgKOH/g. This range can optimize the compatibility with the wax and the effect of oozing the wax. Furthermore, the charging properties and the fixation characteristics are prevented from deteriorating.

In the polyester resin, the following components can be further used.

As the polyhydric alcohol component of the polyester resin, bivalent alcohols such as ethylene glycol, triethylene glycol, 1,2-propylene glycol, 1,3-propylene glycol, 1,4-butane diol, 1,3-butane diol, 1,4-butene diol, 1,5-pentane diol, 1,6-hexane diol and hydrogenated bisphenol A, and trivalent or higher-valent alcohols such as glycerin, trimethylol ethane, trimethylol propane, tris-hydroxyethyl isocyanurate and pentaerythritol can be used. Alcohol components other than these can be used.

As the multibasic acid component constituting the polyester resin, dibasic acids such as succinic acid, adipic acid, sebacic acid, azelaic acid, dodecenyl succinate, n-dodecyl succinate, malonic acid, maleic acid, fumaric acid, citraconic acid, itaconic acid, glutaconic acid, cyclohexane dicarboxylic acid, orthophthalic acid, isophthalic acid and terephthalic acid, tri- or higher basic acids such as trimellitic acid, trimethane acid and pyromellitic acid and their anhydrides, and lower alkyl esters can be used. Acid components other than these can be used.

As the binding resin other than polyester resins, for example, a styrene acrylic resin, an epoxy resin, and a petroleum resin can be used, or a mixture of these resins can be used.

The melting temperature of the binding resin is preferably 105 to 135° C., and more preferably 110 to 130° C. When the melting temperature of the binding resin is lower than 105° C., the cohesion between toner particles is reduced during melting, and the high temperature offset phenomenon in which the toner adheres to the fixation roller occurs. When the melting temperature of the binding resin is higher than 135° C., the toner cannot be fixed at a low temperature, and the requirement for low energy cannot be realized. In the case of color toners, the melting temperature of the binding resin is preferably 95 to 125° C., and more preferably 95 to 115° C. On the other hand, when the melting temperature of the binding resin is lower than 95° C., the cohesion between toner particles is reduced during melting, and the high temperature offset phenomenon in which the toner adheres to the fixation roller occurs. When the melting temperature of the binding resin is higher than 125° C., the toner cannot completely be melted. Thus, the transparency of the toner is poor and the colors cannot be reproduced satisfactorily. Furthermore, it is difficult to smooth the image surface to an appropriate extent, so that the gloss properties are poor. A wide fixation temperature region can be obtained and the fixation characteristics can be improved further by further limiting the melting temperature of the binding resin.

A carboxylic acid-modified paraffin wax or an alcohol-modified paraffin wax having a strong cohesion between the particles and high fixation characteristics is used as the wax contained in the electrophotographic toner of the invention.

The acid value of the carboxylic acid-modified paraffin wax is preferably 4 to 30 mgKOH/g, and more preferably 6 to 25mg KOH/g. This range can optimize the compatibility with the polyester resin and the effect of oozing the wax. In the case of color toners, the acid value of the carboxylic acid-modified paraffin wax is preferably 6 to 25 mgKOH/g, and more preferably 6 to 20 mgKOH/g. This range allows the wax to ooze stably in a sufficient amount to fix the color toners.

The acid value of the alcohol-modified paraffin wax is preferably 2 to 20 mgKOH/g, and more preferably 4 to 15 mgKOH/g. This range can optimize the compatibility with the polyester resin and the effect of oozing the wax. In the case of color toners, the acid value of the alcohol-modified paraffin wax is preferably 4 to 15 mgKOH/g, and more preferably 4 to 13 mgKOH/g. This range allows the wax to ooze stably in a sufficient amount to fix the color toners.

The penetration of the wax is preferably 5 or less, and more preferably 3 or less. When the penetration is larger than 5, the wax is excessively plastic so that the flowability of the toner becomes poor. Thus, uniform charging properties cannot be obtained, and toner scattering or fogging occurs, leading to poor preservability and poor crushing properties during a production process of the toner. Even better charging properties, flowability and preservability can be obtained by further limiting the penetration. In the case of color toners, the penetration of the wax is preferably 3 or less, and more preferably 2 or less. Since the melting temperature of color toners is low so that the preservability tends to be deteriorated, and therefore this range is preferable for the purpose of preventing the preservability from being deteriorated.

The DSC peak temperature of the wax is preferably 75 to 115° C., and more preferably 80 to 110° C. When the DSC peak temperature of the wax is lower than 75° C., the preservability becomes poor. When the DSC peak temperature of the wax is higher than 115° C., the wax hardly oozes and the fixation characteristics are deteriorated. The fixation characteristics can be improved further and the preservability can be obtained by further limiting the range of the DSC peak temperature. In the case of color toners, the DSC peak temperature of the wax is preferably 75 to 110° C., and more preferably 75 to 100° C. In color toners, when the DSC peak temperature of the wax is higher than 110° C., the wax hardly oozes and the fixation characteristics are deteriorated. Even better fixation characteristics and preservability can be obtained by further limiting the range of the DSC peak temperature.

As the paraffin wax contained in the toner, either natural paraffin waxes or synthetic paraffin waxed can be used. The Fischer-Tropsch wax can be mixed thereto.

Furthermore, the amount of the wax added is preferably 1 to 10 parts by weight, and more preferably 1 to 6 parts by weight, with respect to 100 parts by weight of the binding resin. When the amount of the wax added is smaller than 1 part, the wax in the toner particles cannot exhibit effects that can be exhibited in the toner particles. Furthermore, when the amount of the wax added is larger than 10 parts, the flowability of the wax is deteriorated. Thus, the frictional electrification is varied between the toner particles and uniform charging properties cannot be obtained. Consequently, toner scattering or fogging occurs. Even better charging properties can be obtained by further limiting the amount of the wax added.

As the coloring agent of the toner of the invention, various coloring agents, depending on a desired color, such as yellow (Y), magenta (M), cyan (C) and black can be used.

As the coloring agent for yellow (Y) toner, for example, organic pigments such as C.I. Pigment Yellow 1, C.I. Pigment Yellow 5, C.I. Pigment Yellow 12, C.I. Pigment Yellow 15, C.I. Pigment Yellow 17, C.I. Pigment Yellow 180, C.I. Pigment Yellow 93, and C.I. Pigment Yellow 74, which are classified under Color Index (C.I.), and inorganic pigments such as yellow iron oxide and yellow ocher can be used. Furthermore, nitro dyes such as C.I. Acid Yellow 1 and oil soluble dyes such as C.I. Solvent Yellow 2, C.I. Solvent Yellow 6, C.I. Solvent Yellow 14, C.I. Solvent Yellow 15, C.I. Solvent Yellow 19 and C.I. Solvent Yellow 21 can be used.

As the coloring agent for magenta (M) toner, for example, C.I. Pigment Red 49, C.I. Pigment Red 57, C.I. Pigment Red 81, C.I. Pigment Red 122, C.I. Solvent Red 19, C.I. Solvent Red 49, C.I. Solvent Red 52, C.I. Basic Red 10 and C.I. Disperse Red 15 can be used.

As the coloring agent for cyan (C) toner, for example, C.I. Pigment Blue 15, C.I. Pigment Blue 16, C.I. Solvent Blue 55, C.I. Solvent Blue 70, C.I. Direct Blue 25 and C.I. Direct Blue 86 can be used.

As the coloring agent for black (K) toner, for example, carbon black can be used. Any conventionally known dyes or pigments can be used. The content of the coloring agent is preferably 1 to 30 parts by weight, and more preferably 2 to 20 parts by weight, with respect to 100 parts by weight of the binding resin.

The electrophotographic toner of the invention may contain a charge control agent in order to control frictional electrification between toner particles. As the charge control agent for negative charge control, for example, oil soluble dyes such as oil black and Spilon Black, metal-containing azo dyes, metal salts of naphthenic acid, metal salts of alkyl salicylate, fatty acid soaps, resin acid soaps can be used. The content of the charge control agent is preferably 0.1 to 10 parts by weight, and more preferably 0.5 to 8 parts by weight, with respect to 100 parts by weight of the binding resin.

Furthermore, a surface-treatment agent may be contained in order to adjust the flowability and the charging properties of the toner. As the surface-treatment agent, for example, vinylidene fluoride fine powder, polytetrafluoroethylene fine powder, metal salts of fatty acid, zinc stearate, calcium stearate, lead stearate, zinc oxide powder, aluminum oxide powder, titanium oxide powder, fine powdered silica or the like can be used. The content of the surface-treatment agent is preferably 0.01 to 10 parts by weight, and more preferably 0.1 to 5 parts by weight, with respect to 100 parts by weight of the binding resin containing a coloring agent.

The particle size of the toner particles is preferably about 3 to 30 μm as the average particle size, although not limited thereto. In particular, a small particle size of about 9 μm or less is preferable, and the particle size is more preferably 4 to 9 μm, and even more preferably 5 to 8 μm, in order to obtain high quality images.

The electrophotographic toner of the invention can be produced in the following manner. The above-described materials are preliminarily mixed, optionally with other optional additives, uniformly using a dry blender, a super mixer or a ball. Then, the mixture is further melted and kneaded uniformly, for example, with a kneader such as a Bunbury mixer, a roll, a single or double screw extrusion-kneader. Then, the mixture is cooled and crushed, and if necessary, classified.

Hereinafter, examples of the electrophotographic toner of the invention will be described.

EXAMPLES

A black toner A of the invention will be described based on Examples 1 to 10 and Comparative Examples 1 to 11.

Production Example of Black Toner A polyester resin (bisphenol A propylene oxide and terephthalic acid, fumaric acid or trimellitic anhydride

| | |
|---|---|
| polyester resin (bisphenol A propylene oxide and terephthalic acid, fumaric acid or trimellitic anhydride are combined) | 100 parts by weight |
| carbon black | 5 parts by weight |
| charge control agent (zinc salicylate compound) | 2 parts by weight |
| carboxylic acid-modified paraffin wax | 3 parts by weight |

-continued

| | |
|---|---|
| Examples 1 to 8, Comparative Examples 1 to 9 | |
| Example 9 | 8 parts by weight |
| Example 10 | 1 part by weight |
| Comparative Example 10 | 11 parts by weight |
| Comparative Example 11 | 0.5 parts by weight |

The above materials were mixed uniformly with a super mixer, and then the mixture was heated, melted and kneaded with a double screw extruder and cooled. The thus obtained kneaded product was crushed roughly with a cutting mill, and then crushed into fine powder with an ultrasonic jet mill. Then, fine powder having a size of 5 μm or less was removed by a classifier, and thus a classified toner was obtained. The particle size of the classified toner particles was distributed in the range from 5 to 16 μm, and the average particle size was 8.0 μm.

Next, 0.4% of hydrophobic silica as an external additive was added to the classified toner and mixed using a supermixer, and thus a black toner A that is a toner treated with the external additive was obtained. Next, the toner treated with the external additive and a carrier were mixed to produce a developing agent. For the carrier, ferrite particles were used, and the toner concentration of the developing agent was set to 4.0%.

Table 1 shows the melting temperature and the acid value of the polyester resin, and the acid value, the penetration, the DSC peak temperature and the number of parts (the addition amount) of the carboxylic acid-modified paraffin wax used as the materials of Examples 1 to 10 and Comparative Examples 1 to 11.

TABLE 1

| | polyester resin | | carboxylic acid-modified paraffin wax | | | |
|---|---|---|---|---|---|---|
| | melting temperature (° C.) | acid value (mgKOH/g) | acid value (mgKOH/g) | penetration | DSC peak temperature (° C.) | the number of parts |
| Ex. 1 | 125 | 7 | 4 | 3 | 94 | 3 |
| Ex. 2 | 125 | 12 | 13 | 3 | 93 | 3 |
| Ex. 3 | 125 | 20 | 30 | 3 | 92 | 3 |
| Ex. 4 | 125 | 7 | 20 | 3 | 92 | 3 |
| Ex. 5 | 125 | 12 | 14 | 5 | 75 | 3 |
| Ex. 6 | 125 | 12 | 15 | 1 | 115 | 3 |
| Ex. 7 | 135 | 12 | 10 | 3 | 92 | 3 |
| Ex. 8 | 105 | 12 | 13 | 3 | 93 | 3 |
| Ex. 9 | 125 | 12 | 13 | 3 | 93 | 8 |
| Ex. 10 | 125 | 12 | 13 | 3 | 93 | 1 |
| Com. Ex. 1 | 125 | 7 | 3 | 3 | 92 | 3 |
| Com. Ex. 2 | 125 | 5 | 13 | 3 | 93 | 3 |
| Com. Ex. 3 | 125 | 22 | 30 | 3 | 92 | 3 |
| Com. Ex. 4 | 125 | 20 | 35 | 3 | 92 | 3 |
| Com. Ex. 5 | 125 | 12 | 13 | 1 | 117 | 3 |
| Com. Ex. 6 | 125 | 12 | 12 | 6 | 76 | 3 |
| Com. Ex. 7 | 125 | 12 | 13 | 3 | 73 | 3 |
| Com. Ex. 8 | 138 | 12 | 13 | 3 | 93 | 3 |
| Com. Ex. 9 | 102 | 12 | 13 | 3 | 93 | 3 |
| Com. Ex. 10 | 125 | 12 | 13 | 3 | 93 | 11 |
| Com. Ex. 11 | 125 | 12 | 13 | 3 | 93 | 0.5 |

The melting temperature of the polyester resin was measured with a flow tester CFT-500 (manufactured by Shimadzu). The temperature obtained when the stroke of a piston became ½ when being measured at a sample amount of 1.0 g, a cylinder area of 1 $cm^2$, a die size of 1.0 mm (diameter)×1.0 mm (length), an extrusion load of 20kgf/$cm^2$, a temperature increase rate of 6° C./min. a temperature at the start of 60° C. and a preheating time of 300 seconds was taken as the melting temperature. FIG. 1 is a schematic view showing a graph output by the flow tester CFT-500. In FIG. 1, the vertical axis shows the stroke of the piston and the horizontal axis shows the temperature. "Tm" in the horizontal axis shows the point of time at which the stroke became ½. The temperature at this point is the melting temperature.

The penetration of the carboxylic acid-modified paraffin wax was measured according to JIS K2235-5.4.

The DSC peak temperature was measured with DSC 200 manufactured by Seiko Instruments Inc. The temperature of the atmosphere (inert gas) in the electric furnace of an apparatus in which the samples and a reference material were placed was increased from 20° C. to 200° C. at a rate of 10° C./min, and then decreased from 200° C. to 20° C., and this process of increasing and decreasing the temperature was repeated twice, and the temperatures of the samples at the second time of increasing the temperature were measured. Then, the endothermic peaks were detected based on the difference between the temperatures of the samples and the temperature of the reference material, and the temperature at the endothermic peak was taken as the DSC peak temperature.

Printing Test 1

Examples 1 to 10 and Comparative Examples 1 to 11 were subjected to a printing test 1. The procedure and the results will be described below. Table 2 shows the results.

TABLE 2

| | non-offset region (° C.) | fixation strength (%) | preservability | fogging | total evaluation |
|---|---|---|---|---|---|
| Ex. 1 | 110~190 | 81 | G | 0.002 | VG |
| Ex. 2 | 110~210 | 82 | G | 0.002 | VG |
| Ex. 3 | 120~190 | 80 | G | 0.002 | VG |
| Ex. 4 | 110~210 | 86 | G | 0.004 | VG |
| Ex. 5 | 110~210 | 90 | G | 0.001 | VG |
| Ex. 6 | 110~210 | 76 | G | 0.001 | VG |
| Ex. 7 | 120~210 | 83 | G | 0.002 | VG |
| Ex. 8 | 110~190 | 92 | G | 0.001 | VG |
| Ex. 9 | 110~210 | 90 | G | 0.003 | VG |
| Ex. 10 | 120~190 | 73 | G | 0.001 | VG |
| Com. Ex. 1 | 130~160 (x) | 66 (x) | G | 0.001 | P |
| Com. Ex. 2 | 120~190 | 80 | G | 0.008 (x) | G |
| Com. Ex. 3 | 130~160 (x) | 63 (x) | G | 0.001 | P |
| Com. Ex. 4 | 130~160 (x) | 64 (x) | G | 0.001 | P |
| Com. Ex. 5 | 130~170 (x) | 70 | G | 0.002 | G |
| Com. Ex. 6 | 110~210 | 85 | x | 0.008 (x) | P |
| Com. Ex. 7 | 110~210 | 87 | x | 0.001 | G |
| Com. Ex. 8 | 130~180 (x) | 66 (x) | x | 0.001 | P |
| Com. Ex. 9 | 110~150 (x) | 90 | x | 0.001 | P |
| Com. Ex. 10 | 110~210 | 89 | x | 0.010 (x) | P |
| Com. Ex. 11 | 130~160 (x) | 63 (x) | G | 0.001 | P |

The above-described produced toners were used to produce a toner image that has not been fixed, using a copier (AR-S505) manufactured by Sharp Corporation. Then, the fixation device (upper roller: a heat roller formed of fluorocarbon resin, lower roller: a pressure roller formed of silicon rubber) of this copier is modified, and an external fixing machine that can set the roller temperature freely was used to change the roller temperature by 10° C. in the temperature range from 100° C. to 220° C., and thus an unfixed toner image was fixed. Paper feeding was fixed to 180 mm/sec. At this time, the offset phenomenon in which the image is transferred again was observed, and the temperature region in which the image is not transferred again was taken as the non-offset region. A lower temperature of 120° C. or less and a temperature width of 60° C. or more were used as the evaluation criteria of the non-offset region, and a sample satisfying those criteria was regarded as being good.

The image concentration of a fixed image that had been formed at 140° C. was measured with a reflection densitometer manufactured by Macbeth. Then, rubbing with a sand eraser was performed to the fixed image and the image concentration after the rubbing was measured. Then, the fixation strength was calculated based on Equation (1) below. This fixation strength indicates the degree of the adhesion of the fixed image onto the paper and serves as the evaluation criterion of the fixation characteristics. A sample having a fixation strength of 70% or more was regarded as being good.

$$\text{Fixation strength}=(\text{Image concentration after rubbing}/\text{image concentration before rubbing})\times 100 \qquad \text{Equation 1}$$

Furthermore, 10 g of the toner was put in a polyethylene bottle and stored at 50° C. for 7 days for evaluation regarding the preservability. After radiational cooling, the toner was removed from the bottle and the extent of aggregation was visually determined. As the evaluation criterion, in the case where there was no lump in the toner or even if there was a lump, the lump could collapse by being toughed with fingers, then the toner was regarded as being good. In Table 2, letters G and X are used, and a good sample is denoted by "G" and a poor sample is denoted by "X".

The image concentration of a formed fixed image was measured with a reflection densitometer manufactured by Macbeth, and the difference in the concentration between an unused sheet of paper and the white portion of the fixed image was measured so as to evaluate fogging. As the evaluation criterion, a sample having a measurement value of 0.005 or less was regarded as being good.

The total evaluation was performed based on the above-described evaluation of the non-offset region, the fixation strength and the preservability and the fogging. The total evaluation was determined based on the following criteria. A sample categorized as being good regarding all the respects of the non-offset region, the fixation strength, the preservability and the fogging is denoted as being very good (VG). A sample that satisfies the evaluation criterion in all the respects except only one is denoted as being good (G). A sample that satisfies the evaluation criterion in at least one respect of the samples that are not classified as being good is denoted as causing no problem (P), and a sample that satisfies the evaluation criterion in none of the respects is denoted as causing a problem in practical use (X). In this example, there is no sample that satisfies the evaluation criterion in none of the respects. In Table 2, signs "VG", "G" and "P" are used to indicate the evaluation.

As shown in Table 2, the total evaluation of Examples 1 to 10 are all very good (VG). This is because the acid value of the polyester resin and the wax, the melting temperature of the polyester resin, and the penetration, the DSC peak temperature and the number of parts of the wax were all in the predetermined ranges.

Among these, the best values regarding the non-offset region, the fixation strength and the preservability and the fogging were as follows. Regarding the non-offset region, a wide fixation temperature region of 110° C. to 210° C. with a lowest temperature of 110° C., which is low, was obtained. Regarding the fixation strength, a high value of 92% was obtained. Regarding the fogging, a small value of 0.001 was obtained. The preservability in all Examples 1 to 10 was good.

The total evaluations of Comparative Examples 1 to 11 were good (G) for Comparative Examples 2, 5 and 7, and of no particular problem in practice (P) for Comparative Examples 1, 3, 4, 6, 8 to 11. The details of Comparative Examples 2, 5 and 7 are as follows.

Comparative Example 2 was good in all the respects except fogging. The value for fogging was larger than the evaluation criterion because the acid value of the polyester resin was 5 mgKOH/g, which is lower than the range of 7 to 20 mgKOH/g, so that the compatibility was deteriorated and thus the charging properties were deteriorated.

Comparative Example 5 was good in all the respects except the non-offset region. The value for the non-offset region was below the evaluation criterion because the DSC peak temperature of the wax was 117° C., which is higher than the range of 75 to 115° C.

Comparative Example 7 was good in all the respects except the preservability. The preservability was below the evaluation criterion because the DSC peak temperature of the wax was 73° C., which is lower than the range of 75 to 115° C.

The details of Comparative Examples 1, 3, 4, 6, 8 to 11 are as follows.

Comparative Example 1 was good in the respects of the preservability and the fogging. The acid value of the wax was 3 mgKOH/g, which is lower than the range of 4 to 30 mgKOH/g, so that the lower limit of the non-offset region exceeded 120° C. and the temperature width was less than 60° C. Furthermore, the fixation strength was below the evaluation criterion.

Comparative Example 3 was good in the respects of the preservability and the fogging. The acid value of the polyester resin was 22 mgKOH/g, which is higher than the range of 7 to 20 mgKOH/g, so that the lower limit of the non-offset region exceeded 120° C. and the temperature width was less than 60° C. Furthermore, the fixation strength was below the evaluation criterion.

Comparative Example 4 was good in the respects of the preservability and the fogging. The acid value of the wax was 35 mgKOH/g, which is higher than the range of 4 to 30 mgKOH/g, so that the lower limit of the non-offset region exceeded 120° C. and the temperature width was less than 60° C. Furthermore, the fixation strength was below the evaluation criterion.

Comparative Example 6 was good in the respects of the non-offset region and the fixation strength. The penetration of the wax was 6, which is larger than 5, so that the preservability was below the evaluation criterion. The fogging was larger than the evaluation criterion.

Comparative Example 8 was good in the respect of the fogging. The melting temperature of the polyester resin was 138° C., which is higher than the range of 105 to 135° C., so that the lower limit of the non-offset region exceeded 120° C. and the temperature width was less than 60° C. Furthermore, the fixation strength and the preservability were below the evaluation criterion.

Comparative Example 9 was good in the respects of the fixation strength and the fogging. The melting temperature of the polyester resin was 102° C., which is lower than the range of 105 to 135° C., so that the temperature width of the non-offset region was less than 60° C. Furthermore, the preservability was below the evaluation criterion.

Comparative Example 10 was good in the respects of the non-offset region and the fixation strength. The content of the wax was 11 parts, which is larger than 10 parts, so that the fogging was larger than the evaluation criterion. Furthermore, the preservability was below the evaluation criterion.

Comparative Example 11 was good in the respects of the preservability and the fogging. The content of the wax was 0.5 parts, which is smaller than 1 part, so that the lower limit of the non-offset region exceeded 120° C. and the temperature width was less than 60° C. Furthermore, the fixation strength was below the evaluation criterion.

A black toner B of the invention will be described based on Examples 1a to 10a and Comparative Examples 1a to 11a.

Production Example of Black Toner B polyester resin (bisphenol A propylene oxide and terephthalic acid, fumaric acid or trimellitic anhydride

| | |
|---|---|
| polyester resin (bisphenol A propylene oxide and terephthalic acid, fumaric acid or trimellitic anhydride are combined) | 100 parts by weight |
| carbon black | 5 parts by weight |
| charge control agent (zinc salicylate compound) | 2 parts by weight |
| alcohol-modified paraffin wax | |
| Examples 1a to 8a, Comparative Examples 1a to 9a | 3 parts by weight |
| Example 9a | 8 parts by weight |
| Example 10a | 1 part by weight |
| Comparative Example 10a | 11 parts by weight |
| Comparative Example 11a | 0.5 parts by weight |

Using the above materials, a classified toner was obtained in the same manner as in the production example of the black toner A. The particle size was distributed in the range from 5 to 16 μm, and the average particle size was 8.0 μm.

Next, a black toner B that is a toner treated with an external additive was obtained from a classified toner in the same manner as in the production example of the black toner A, and the toner treated with an external additive and a carrier were mixed to produce a developing agent. For the carrier, ferrite particles were used, and the toner concentration of the developing agent was set to 4.0%.

Table 3 shows the melting temperature and the acid value of the polyester resin, and the acid value, the penetration, the DSC peak temperature and the number of parts of the alcohol-modified paraffin wax used as the materials of Examples 1a to 10a and Comparative Examples 1a to 11a.

TABLE 3

| | polyester resin | | alcohol-modified paraffin wax | | | |
|---|---|---|---|---|---|---|
| | melting temperature (° C.) | acid value (mgKOH/g) | acid value (mgKOH/g) | penetration | DSC peak temperature (° C.) | the number of parts |
| Ex. 1a | 125 | 5 | 2 | 3 | 92 | 3 |
| Ex. 2a | 125 | 12 | 10 | 3 | 92 | 3 |
| Ex. 3a | 125 | 20 | 20 | 3 | 92 | 3 |
| Ex. 4a | 125 | 5 | 20 | 3 | 92 | 3 |
| Ex. 5a | 125 | 12 | 10 | 5 | 75 | 3 |
| Ex. 6a | 125 | 12 | 10 | 1 | 115 | 3 |
| Ex. 7a | 135 | 12 | 10 | 3 | 92 | 3 |
| Ex. 8a | 105 | 12 | 10 | 3 | 92 | 3 |
| Ex. 9a | 125 | 12 | 10 | 3 | 92 | 8 |
| Ex. 10a | 125 | 12 | 10 | 3 | 92 | 1 |
| Com. Ex. 1a | 125 | 5 | 1 | 3 | 92 | 3 |
| Com. Ex. 2a | 125 | 4 | 10 | 3 | 92 | 3 |
| Com. Ex. 3a | 125 | 22 | 20 | 3 | 92 | 3 |
| Com. Ex. 4a | 125 | 20 | 23 | 3 | 92 | 3 |
| Com. Ex. 5a | 125 | 12 | 10 | 1 | 118 | 3 |
| Com. Ex. 6a | 125 | 12 | 10 | 6 | 76 | 3 |
| Com. Ex. 7a | 125 | 12 | 10 | 3 | 73 | 3 |
| Com. Ex. 8a | 138 | 12 | 10 | 3 | 92 | 3 |
| Com. Ex. 9a | 102 | 12 | 10 | 3 | 92 | 3 |
| Com. Ex. 10a | 125 | 12 | 10 | 3 | 92 | 11 |
| Com. Ex. 11a | 125 | 12 | 10 | 3 | 92 | 0.5 |

The melting temperature of the polyester resin, the penetration and the DSC peak temperature of the wax were obtained under the same conditions as in the production example of the black toner A.

Printing Test 2

Examples 1a to 10a and Comparative Examples 1a to 11a were subjected to a printing test 2. The procedure, the conditions and the evaluation method were the same as in the case of the printing test 1, and therefore the results will be described below. Table 4 shows the results.

TABLE 4

| | non-offset region (° C.) | fixation strength (%) | preservability | fogging | total evaluation |
|---|---|---|---|---|---|
| Ex. 1a | 110~190 | 80 | G | 0.002 | VG |
| Ex. 2a | 110~210 | 83 | G | 0.001 | VG |
| Ex. 3a | 120~190 | 79 | G | 0.002 | VG |
| Ex. 4a | 110~210 | 85 | G | 0.004 | VG |
| Ex. 5a | 110~210 | 89 | G | 0.001 | VG |
| Ex. 6a | 110~210 | 75 | G | 0.001 | VG |
| Ex. 7a | 120~210 | 82 | G | 0.002 | VG |
| Ex. 8a | 110~190 | 90 | G | 0.001 | VG |
| Ex. 9a | 110~210 | 91 | G | 0.003 | VG |
| Ex. 10a | 120~190 | 74 | G | 0.001 | VG |
| Com. Ex. 1a | 130~160 (x) | 65 (x) | G | 0.001 | P |
| Com. Ex. 2a | 120~190 | 78 | G | 0.007 (x) | G |
| Com. Ex. 3a | 130~160 (x) | 62 (x) | G | 0.001 | P |

TABLE 4-continued

| | non-offset region (° C.) | fixation strength (%) | preservability | fogging | total evaluation |
|---|---|---|---|---|---|
| Com. Ex. 4a | 130~160 (x) | 62 (x) | G | 0.001 | P |
| Com. Ex. 5a | 130~170 (x) | 68 (x) | G | 0.002 | P |
| Com. Ex. 6a | 110~210 | 83 | x | 0.008 (x) | P |
| Com. Ex. 7a | 110~210 | 86 | x | 0.001 | G |
| Com. Ex. 8a | 130~180 (x) | 65 (x) | G | 0.001 | P |
| Com. Ex. 9a | 110~150 (x) | 90 | x | 0.001 | P |
| Com. Ex. 10a | 110~210 | 87 | x | 0.009 (x) | p |
| Com. Ex. 11a | 130~160 (x) | 62 (x) | G | 0.001 | P |

As shown in Table 4, the total evaluations of Examples 1a to 10a are very good (VG). This is because the acid values of the polyester resin and the wax, the melting temperature of the polyester resin, and the penetration, the DSC peak temperature and the number of parts of the wax were all in the predetermined ranges.

Among these, the best values regarding the non-offset region, the fixation strength and the preservability and the fogging were as follows. Regarding the non-offset region, a wide fixation temperature region of 110° C. to 210° C. with a lower limit temperature of 110° C., which is low, was obtained. Regarding the fixation strength, a high value of 91% was obtained. Regarding the fogging, a small value of 0.001 was obtained. The preservability in all Examples 1a to 10a was good.

The total evaluations of Comparative Examples 1a to 11a were good (G) for Comparative Examples 2a and 7a and of no particular problem in practice (P) for Comparative Examples 1a, 3a to 6a, 8a to 11a. The details of Comparative Examples 2a and 7a are as follows.

Comparative Example 2a was good in all the respects except fogging. The value for fogging was larger than the evaluation criterion because the acid value of the polyester resin was 4 mgKOH/g, which is lower than the range of 5 to 20 mgKOH/g, so that the compatibility was deteriorated and thus the charging properties were deteriorated.

Comparative Example 7a was good in all the respects except the preservability. The value for the preservability was below the evaluation criterion because the DSC peak temperature of the wax was 73° C., which is higher than the range of 75 to 115° C.

The details of Comparative Examples 1a, 3a to 6a, 8a to 11a are as follows.

Comparative Example 1a was good in the respects of the preservability and the fogging. The acid value of the wax was 1 mgKOH/g, which is lower than the range of 2 to 20 mgKOH/g, so that the lower limit of the non-offset region exceeded 120° C. and the temperature width was less than 60° C. Furthermore, the fixation strength was below the evaluation criterion.

Comparative Example 3a was good in the respects of the preservability and the fogging. The acid value of the polyester resin was 22 mgKOH/g, which is higher than the range of 2 to 20 mgKOH/g, so that the lower limit of the non-offset region exceeded 120° C. and the temperature width was less than 60° C. Furthermore, the fixation strength was below the evaluation criterion.

Comparative Example 4a was good in the respects of the preservability and the fogging. The acid value of the wax was 23 mgKOH/g, which is higher than the range of 2 to 20 mgKOH/g, so that the lower limit of the non-offset region exceeded 120° C. and the temperature width was less than 60° C. Furthermore, the fixation strength was below the evaluation criterion.

Comparative Example 5a was good in the respects of the preservability and the fogging. The DSC peak temperature of the wax was 118° C., which is higher than the range of 75 to 115° C., so that the lower limit of the non-offset region exceeded 120° C. and the temperature width was less than 60° C. Furthermore, the fixation strength was below the evaluation criterion.

Comparative Example 6a was good in the respects of the non-offset region and the fixation strength. The penetration of the wax was 6, which is larger than 5, so that the preservability was below the evaluation criterion. The fogging was larger than the evaluation criterion.

Comparative Example 8a was good in the respects of the preservability and the fogging. The melting temperature of the polyester resin was 138° C., which is higher than the range of 105 to 135° C., so that the lower limit of the non-offset region exceeded 120° C. and the temperature width was less than 60° C. Furthermore, the fixation strength was below the evaluation criterion.

Comparative Example 9a was good in the respects of the fixation strength and the fogging. The melting temperature of the polyester resin was 102° C., which is lower than the range of 105 to 135° C., so that the temperature width of the non-offset region was less than 60° C. Furthermore, the preservability was below the evaluation criterion.

Comparative Example 10a was good in the respects of the non-offset region and the fixation strength. The content of the wax was 11 parts, which is larger than 10 parts, so that the fogging was larger than the evaluation criterion. Furthermore, the preservability was below the evaluation criterion.

Comparative Example 11a was good in the respects of the preservability and the fogging. The content of the wax was 0.5 parts, which is smaller than 1 part, so that the lower limit of the non-offset region exceeded 120° C. and the temperature width was less than 60° C. Furthermore, the fixation strength was below the evaluation criterion.

Next, a cyan toner A, which is a color toner, of the invention will be described based on Examples 11 to 20 and Comparative Examples 12 to 22.

Production Example of Cyan Toner A polyester resin (bisphenol A propylene oxide and terephthalic acid, fumaric acid or trimellitic anhydride

| | |
|---|---|
| polyester resin (bisphenol A propylene oxide and terephthalic acid, fumaric acid or trimellitic anhydride are combined) | 100 parts by weight |
| copper phthalocyanine (C.I. Pigment Blue 15) | 5 parts by weight |
| charge control agent (zinc salicylate compound) | 2 parts by weight |
| carboxylic acid-modified paraffin wax | 3 parts by weight |
| Examples 11 to 18, Comparative Examples 12 to 20 | |
| Example 19 | 8 parts by weight |
| Example 20 | 1 part by weight |
| Comparative Example 21 | 11 parts by weight |
| Comparative Example 22 | 0.5 parts by weight |

The above materials were mixed uniformly with a super mixer, and then the mixture was heated, melted and kneaded with a double screw extruder and cooled. The thus obtained kneaded product was crushed roughly with a cutting mill, and then crushed into fine powder with an ultrasonic jet mill. Then, fine powder having a size of 5 μm or less was removed by a classifier, and thus a classified toner was obtained. The particle size of the classified toner particles was distributed in the range from 5 to 16 μm, and the average particle size was 8.0 μm Next, 0.4% of hydrophobic silica as an external additive was added to the classified toner and mixed using a super mixer, and thus a cyan toner A that is a toner treated with the external additive was obtained. Next, the toner treated with the external additive and a carrier were mixed to produce a developing agent. For the carrier, ferrite particles were used and the toner concentration of the developing agent was set to 4.0%.

Table 5 shows the melting temperature and the acid value of the polyester resin, and the acid value, the penetration, the DSC peak temperature and the number of parts (the addition amount) of the carboxylic acid-modified paraffin wax used as the materials of Examples 11 to 20 and Comparative Examples 12 to 22.

TABLE 5

| | polyester resin | | carboxylic acid-modified paraffin wax | | | |
|---|---|---|---|---|---|---|
| | melting temperature (° C.) | acid value (mgKOH/g) | acid value (mgKOH/g) | penetration | DSC peak temperature (° C.) | the number of parts |
| Ex. 11 | 110 | 7 | 6 | 2 | 84 | 3 |
| Ex. 12 | 110 | 11 | 14 | 2 | 85 | 3 |
| Ex. 13 | 110 | 20 | 15 | 2 | 85 | 3 |
| Ex. 14 | 110 | 7 | 25 | 2 | 85 | 3 |
| Ex. 15 | 110 | 11 | 15 | 3 | 75 | 3 |
| Ex. 16 | 110 | 11 | 15 | 1 | 110 | 3 |
| Ex. 17 | 125 | 11 | 15 | 2 | 85 | 3 |
| Ex. 18 | 95 | 12 | 15 | 2 | 85 | 3 |
| Ex. 19 | 110 | 11 | 15 | 2 | 85 | 8 |
| Ex. 20 | 110 | 11 | 15 | 2 | 85 | 1 |
| Com. Ex. 12 | 110 | 7 | 4 | 2 | 85 | 3 |
| Com. Ex. 13 | 110 | 5 | 15 | 2 | 85 | 3 |
| Com. Ex. 14 | 110 | 22 | 25 | 3 | 86 | 3 |
| Com. Ex. 15 | 110 | 20 | 35 | 2 | 85 | 3 |
| Com. Ex. 16 | 110 | 11 | 15 | 1 | 113 | 3 |
| Com. Ex. 17 | 110 | 11 | 14 | 4 | 76 | 3 |
| Com. Ex. 18 | 110 | 11 | 13 | 3 | 73 | 3 |
| Com. Ex. 19 | 128 | 11 | 9 | 2 | 85 | 3 |
| Com. Ex. 20 | 93 | 12 | 9 | 2 | 85 | 3 |
| Com. Ex. 21 | 110 | 11 | 9 | 2 | 85 | 11 |
| Com. Ex. 22 | 110 | 11 | 9 | 3 | 92 | 0.5 |

The melting temperature of the polyester resin, the penetration and the DSC peak temperature of the wax were obtained under the same conditions as in the production example of the black toner A.

Printing Test 3

Examples 11 to 20 and Comparative Examples 12 to 22 were subjected to a printing test 3. The procedure and the results will be described below. Table 6 shows the results.

TABLE 6

| | non-offset region (° C.) | fixation strength (%) | preservability | fogging | total evaluation |
|---|---|---|---|---|---|
| Ex. 11 | 120~180 | 84 | G | 0.002 | VG |
| Ex. 12 | 120~200 | 88 | G | 0.002 | VG |
| Ex. 13 | 130~180 | 82 | G | 0.002 | VG |
| Ex. 14 | 120~180 | 90 | G | 0.002 | VG |
| Ex. 15 | 120~200 | 91 | G | 0.001 | VG |
| Ex. 16 | 120~200 | 82 | G | 0.001 | VG |
| Ex. 17 | 130~200 | 87 | G | 0.002 | VG |
| Ex. 18 | 130~180 | 92 | G | 0.001 | VG |
| Ex. 19 | 120~200 | 95 | G | 0.004 | VG |
| Ex. 20 | 130~180 | 83 | G | 0.001 | VG |
| Com. Ex. 12 | 130~150 (x) | 72 (x) | G | 0.001 | P |
| Com. Ex. 13 | 130~180 | 83 | G | 0.008 (x) | G |
| Com. Ex. 14 | 130~150 (x) | 69 (x) | G | 0.001 | P |
| Com. Ex. 15 | 130~150 (x) | 72 (x) | G | 0.001 | P |
| Com. Ex. 16 | 140~170 (x) | 72 (x) | G | 0.002 | P |

TABLE 6-continued

| | non-offset region (° C.) | fixation strength (%) | preservability | fogging | total evaluation |
|---|---|---|---|---|---|
| Com. Ex. 17 | 120–200 | 89 | x | 0.008 (x) | P |
| Com. Ex. 18 | 120~200 | 92 | x | 0.001 | G |
| Com. Ex. 19 | 150~170 (x) | 70 (x) | x | 0.001 | P |
| Com. Ex. 20 | 110~140 (x) | 93 | x | 0.001 | P |
| Com. Ex. 21 | 120~200 | 92 | x | 0.009 (x) | P |
| Com. Ex. 22 | 140~150 (x) | 69 (x) | G | 0.001 | P |

The above-described produced toners were used to produce a toner image that has not been fixed, using a copier (AR-S505) manufactured by Sharp Corporation. Then, the fixation device (upper roller: a mirror finish heat roller formed of silicon rubber, lower roller: a pressure roller formed of silicon rubber) of a copier (AR-C150) manufactured by Sharp Corporation is modified, and an external fixing machine that can set the roller temperature freely was used to change the roller temperature by 10° C. in the temperature range from 100° C. to 220° C. A silicon oil supplying mechanism was removed, and then an unfixed toner image was fixed in an oil-less state. The rate of paper feeding was fixed to 120 mm/sec. At this time, the offset phenomenon in which the image is transferred again was observed, and the temperature region in which the image is not transferred again was taken as the non-offset region. A temperature width of 50° C. or more was used as the evaluation criterion for the non-offset region, and a sample satisfying this criterion was regarded as being good.

The image concentration of a fixed image that had been formed at 150° C. was measured with a reflection densitometer manufactured by Macbeth. Then, rubbing with a sand eraser was performed to the fixed image and the image concentration after the rubbing was measured. Then, the fixation strength was calculated based on Equation (1) above. As the evaluation criterion, in view of the melting and mixing properties of particles of a color toner, a sample having a fixation strength of 80% or more was regarded as being good.

Furthermore, 10 g of the color toner was put in a polyethylene bottle and stored at 45° C. for 7 days for evaluation regarding the preservability. After radiational cooling, the toner was removed from the bottle and the extent of aggregation was visually determined. As the evaluation criterion, in the case where there was no lump in the toner or even if there was a lump, the lump could collapse by being toughed with fingers, then the toner was regarded as being good. In Table 6, letters G and x are used, and a good sample is denoted by "G" and a poor sample is denoted by "X".

The image concentration of a formed fixed image was measured with a reflection densitometer manufactured by Macbeth, and the difference in the concentration between an unused sheet of paper and the white portion of the fixed image was measured so as to evaluate fogging. As the evaluation criterion, a sample having a measurement value of 0.005 or less was regarded as being good.

The total evaluation was performed based on the above-described evaluation of the non-offset region, the fixation strength and the preservability and the fogging. The method for the total evaluation was the same as in the printing test 1.

As shown in Table 6, the total evaluation of Examples 11 to 20 are all very good (VG). This is because the acid values of the polyester resin and the wax, the melting temperature of the polyester resin, and the penetration, the DSC peak temperature and the number of parts of the wax were all in the predetermined ranges.

Among these, the best values regarding the non-offset region, the fixation strength and the preservability and the fogging were as follows. Regarding the non-offset region, a wide fixation temperature region of 120° C. to 200° C. was obtained. Regarding the fixation strength, a high value of 95% was obtained. Regarding the fogging, a small value of 0.001 was obtained. The preservability in all Examples 11 to 20 was good.

The total evaluations of Comparative Examples 12 to 22 were good (G) for Comparative Examples 13 and 18, and of no particular problem in practice (P) for Comparative Examples 12, 14 to 17, 19 to 22. The details of Comparative Examples 13 and 18 are as follows.

Comparative Example 13 was good in all the respects except fogging. The value for fogging was larger than the evaluation criterion because the acid value of the polyester resin was 5 mgKOH/g, which is lower than the range of 7 to 20 mgKOH/g, so that the compatibility was deteriorated and thus the charging properties were deteriorated.

Comparative Example 18 was good in all the respects except the preservability. The value for the preservability was below the evaluation criterion because the DSC peak temperature of the wax was 73° C., which is higher than the range of 75 to 110° C.

The details of Comparative Examples 12, 14 to 17 and 19 to 22 are as follows.

Comparative Example 12 was good in the respects of the preservability and the fogging. The acid value of the wax was 4 mgKOH/g, which is lower than the range of 6 to 25 mgKOH/g, so that the temperature width of the non-offset region was less than 50° C. Furthermore, the fixation strength was below the evaluation criterion.

Comparative Example 14 was good in the respects of the preservability and the fogging. The acid value of the polyester resin was 22 mgKOH/g, which is higher than the range of 7 to 20 mgKOH/g, so that the temperature width of the non-offset region was less than 50° C. Furthermore, the fixation strength was below the evaluation criterion.

Comparative Example 15 was good in the respects of the preservability and the fogging. The acid value of the wax was 35 mgKOH/g, which is higher than the range of 6 to 25 mgKOH/g, so that the temperature width of the non-offset region was less than 50° C. Furthermore, the fixation strength was below the evaluation criterion.

Comparative Example 16 was good in the respects of the preservability and the fogging. The DSC peak temperature of the wax was 113° C., which is higher than the range of 75 to 110° C., so that the temperature width of the non-offset region was less than 50° C. Furthermore, the fixation strength was below the evaluation criterion.

Comparative Example 17 was good in the respects of the non-offset region and the fixation strength. The penetration of the wax was 4, which is larger than 3, so that the preservability was below the evaluation criterion. The fogging was larger than the evaluation criterion.

Comparative Example 19 was good in the respect of the fogging. The melting temperature of the polyester resin was 128° C., which is higher than the range of 95 to 125° C., so that the temperature width of the non-offset region was less than 50° C. Furthermore, the fixation strength and the preservability were below the evaluation criterion.

Comparative Example 20 was good in the respects of the fixation strength and the fogging. The melting temperature of the polyester resin was 93° C., which is lower than the range of 95 to 125° C., so that the temperature width of the non-offset region was less than 50° C. Furthermore, the preservability was below the evaluation criterion.

Comparative Example 21 was good in the respects of the non-offset region and the fixation strength. The content of the wax was 11 parts, which is larger than 10 parts, so that the fogging was larger than the evaluation criterion. Furthermore, the preservability was below the evaluation criterion.

Comparative Example 22 was good in the respects of the preservability and the fogging. The content of the wax was 0.5 parts, which is smaller than 1 part, so that the temperature width of the non-offset region was less than 50° C. Furthermore, the fixation strength was below the evaluation criterion.

Furthermore, a cyan toner B, which is a color toner of the invention, will be described based on Examples 11a to 20a and Comparative Examples 12a to 22a.

Production Example of Cyan Toner B polyester resin (bisphenol A propylene oxide and terephthalic acid, fumaric acid or trimellitic anhydride

| | |
|---|---|
| polyester resin (bisphenol A propylene oxide and terephthalic acid, fumaric acid or trimellitic anhydride are combined) | 100 parts by weight |
| copper phthalocyanine (C.I. Pigment Blue 15) | 5 parts by weight |

-continued

| | |
|---|---|
| charge control agent (zinc salicylate compound) | 2 parts by weight |
| alcohol-modified paraffin wax | 3 parts by weight |
| Examples 11a to 18a, Comparative Examples 12a to 20a | |
| Example 19a | 8 parts by weight |
| Example 20a | 1 part by weight |
| Comparative Example 21a | 11 parts by weight |
| Comparative Example 22a | 0.5 parts by weight |

Using the above materials, a classified toner was obtained in the same manner as in the production example of the cyan toner A. The particle size was distributed in the range from 5 to 16 μm, and the average particle size was 8.0 μm.

Next, a cyan toner B that is a toner treated with an external additive was obtained from a classified toner in the same manner as in the production example of the cyan toner A, and the toner treated with an external additive and a carrier were mixed to produce a developing agent. For the carrier, ferrite particles were used, and the toner concentration of the developing agent was set to 4.0%.

Table 7 shows the melting temperature and the acid value of the polyester resin, and the acid value, the penetration, the DSC peak temperature and the number of parts of the alcohol-modified paraffin wax used as the materials of Examples 11a to 20a and Comparative Examples 12a to 22a.

TABLE 7

| | polyester resin | | alcohol modified paraffin wax | | | |
|---|---|---|---|---|---|---|
| | melting temperature (° C.) | acid value (mgKOH/g) | acid value (mgKOH/g) | penetration | DSC peak temperature (° C.) | the number of parts |
| Ex. 11a | 110 | 5 | 4 | 2 | 85 | 3 |
| Ex. 12a | 110 | 11 | 9 | 2 | 85 | 3 |
| Ex. 13a | 110 | 20 | 15 | 2 | 85 | 3 |
| Ex. 14a | 110 | 5 | 15 | 2 | 85 | 3 |
| Ex. 15a | 110 | 11 | 9 | 3 | 75 | 3 |
| Ex. 16a | 110 | 11 | 9 | 1 | 110 | 3 |
| Ex. 17a | 125 | 11 | 9 | 2 | 85 | 3 |
| Ex. 18a | 95 | 12 | 9 | 2 | 85 | 3 |
| Ex. 19a | 110 | 11 | 9 | 2 | 85 | 8 |
| Ex. 20a | 110 | 11 | 9 | 2 | 85 | 1 |
| Com. Ex. 12a | 110 | 5 | 3 | 2 | 85 | 3 |
| Com. Ex. 13a | 110 | 4 | 10 | 2 | 85 | 3 |
| Com. Ex. 14a | 110 | 22 | 15 | 3 | 86 | 3 |
| Com. Ex. 15a | 110 | 20 | 17 | 2 | 85 | 3 |
| Com. Ex. 16a | 110 | 11 | 9 | 1 | 113 | 3 |
| Com. Ex. 17a | 110 | 11 | 9 | 4 | 76 | 3 |
| Com. Ex. 18a | 110 | 11 | 9 | 3 | 73 | 3 |
| Com. Ex. 19a | 128 | 11 | 9 | 2 | 85 | 3 |
| Com. Ex. 20a | 93 | 12 | 9 | 2 | 85 | 3 |
| Com. Ex. 21a | 110 | 11 | 9 | 2 | 85 | 11 |
| Com. Ex. 22a | 110 | 11 | 9 | 3 | 92 | 0.5 |

The melting temperature of the polyester resin, the penetration and the DSC peak temperature of the wax were obtained under the same conditions as in the production example of the cyan toner A.

Printing Test 4

Examples 11a to 20a and Comparative Examples 12a to 22a were subjected to a printing test 4. The procedure, the conditions and the evaluation method were the same as in the case of the printing test 3, and therefore the results will be described below. Table 8 shows the results.

TABLE 8

| | non-offset region (° C.) | fixation strength (%) | preservability | fogging | total evaluation |
|---|---|---|---|---|---|
| Ex. 11a | 120~180 | 83 | G | 0.002 | VG |
| Ex. 12a | 120~200 | 87 | G | 0.002 | VG |
| Ex. 13a | 130~180 | 81 | G | 0.002 | VG |
| Ex. 14a | 120~180 | 89 | G | 0.003 | VG |
| Ex. 15a | 120~200 | 92 | G | 0.001 | VG |
| Ex. 16a | 120~200 | 81 | G | 0.001 | VG |
| Ex. 17a | 130~200 | 86 | G | 0.002 | VG |
| Ex. 18a | 130~180 | 93 | G | 0.001 | VG |
| Ex. 19a | 120~200 | 94 | G | 0.003 | VG |
| Ex. 20a | 130~180 | 82 | G | 0.001 | VG |

TABLE 8-continued

| | non-offset region (° C.) | fixation strength (%) | preservability | fogging | total evaluation |
|---|---|---|---|---|---|
| Com. Ex. 12a | 130~150 (x) | 71 (x) | G | 0.001 | P |
| Com. Ex. 13a | 130~180 | 82 | G | 0.008 (x) | G |
| Com. Ex. 14a | 130–150 (x) | 68 (x) | G | 0.001 | P |
| Com. Ex. 15a | 130–150 (x) | 71 (x) | G | 0.001 | P |
| Com. Ex. 16a | 140~170 (x) | 73 (x) | G | 0.002 | P |
| Com. Ex. 17a | 120~200 | 88 | x | 0.009 (x) | P |
| Com. Ex. 18a | 120~200 | 91 | x | 0.001 | G |
| Com. Ex. 19a | 150~170 (x) | 70 (x) | x | 0.001 | P |
| Com. Ex. 20a | 110~140 (x) | 94 | x | 0.001 | P |
| Com. Ex. 21a | 120~200 | 92 | x | 0.009 (x) | P |
| Com. Ex. 22a | 140~150 (x) | 68 (x) | G | 0.001 | P |

As shown in Table 8, the total evaluation of Examples 11a to 20a are all very good (VG). This is because the acid values of the polyester resin and the wax, the melting temperature of the polyester resin, and the penetration, the DSC peak temperature and the number of parts of the wax were all in the predetermined ranges.

Among these, the best values regarding the non-offset region, the fixation strength and the preservability and the fogging were as follows. Regarding the non-offset region, a wide fixation temperature region of 120° C. to 200° C. was obtained. Regarding the fixation strength, a high value of 94% was obtained. Regarding the fogging, a small value of 0.001 was obtained. The preservability in all Examples 11a to 20a was good.

The total evaluations of Comparative Examples 12a to 22a were good (G) for Comparative Examples 13a and 18a, and of no particular problem in practice (P) for Comparative Examples 12a, 14a to 17a, 19a to 22a. The details of Comparative Examples 13a and 18a are as follows.

Comparative Example 13a was good in all the respects except fogging. The value for fogging was larger than the evaluation criterion because the acid value of the polyester resin was 4 mgKOH/g, which is lower than the range of 5 to 20 mgKOH/g, so that the compatibility was deteriorated and thus the charging properties were deteriorated.

Comparative Example 18a was good in all the respects except the preservability. The value for the preservability was below the evaluation criterion because the DSC peak temperature of the wax was 73° C., which is lower than the range of 75 to 110° C.

The details of Comparative Examples 12a, 14a to 17a and 19a to 22a are as follows.

Comparative Example 12a was good in the respects of the preservability and the fogging. The acid value of the wax was 3 mgKOH/g, which is lower than the range of 4 to 15 mgKOH/g, so that the temperature width of the non-offset region was less than 50° C. Furthermore, the fixation strength was below the evaluation criterion.

Comparative Example 14a was good in the respects of the preservability and the fogging. The acid value of the polyester resin was 22 mgKOH/g, which is higher than the range of 5 to 20 mgKOH/g, so that the temperature width of the non-offset region was less than 50° C. Furthermore, the fixation strength was below the evaluation criterion.

Comparative Example 15a was good in the respects of the preservability and the fogging. The acid value of the wax was 17 mgKOH/g, which is higher than the range of 4 to 15 mgKOH/g, so that the temperature width of the non-offset region was less than 50° C. Furthermore, the fixation strength was below the evaluation criterion.

Comparative Example 16a was good in the respects of the preservability and the fogging. The DSC peak temperature of the wax was 113° C., which is higher than the range of 75 to 110° C., so that the temperature width of the non-offset region was less than 50° C. Furthermore, the fixation strength was below the evaluation criterion.

Comparative Example 17a was good in the respects of the non-offset region and the fixation strength. The penetration of the wax was 4, which is larger than 3, so that the preservability was below the evaluation criterion. The fogging was larger than the evaluation criterion.

Comparative Example 19a was good in the respect of the fogging. The melting temperature of the polyester resin was 128° C., which is higher than the range of 95 to 125° C., so that the temperature width of the non-offset region was less than 50° C. Furthermore, the fixation strength and the preservability were below the evaluation criterion.

Comparative Example 20a was good in the respects of the fixation strength and the fogging. The melting temperature of the polyester resin was 93° C., which is lower than the range of 95 to 125° C., so that the temperature width of the non-offset region was less than 50° C. Furthermore, the preservability was below the evaluation criterion.

Comparative Example 21a was good in the respects of the non-offset region and the fixation strength. The content of the wax was 11 parts, which is larger than 10 parts, so that the fogging was larger than the evaluation criterion. Furthermore, the preservability was below the evaluation criterion.

Comparative Example 22a was good in the respects of the preservability and the fogging. The content of the wax was 0.5 parts, which is smaller than 1 part, so that the temperature width of the non-offset region was less than 50° C. Furthermore, the fixation strength was below the evaluation criterion.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic black toner comprising:

a binding resin made of a polyester resin having an acid value of 20 mgKOH/g;

a wax made of a carboxylic acid-modified paraffin wax having an acid value of 30 mgKOH/g, wherein the DSC peak temperature of the wax is 92° C.; and a coloring agent.

2. The electrophotographic black toner of claim 1, wherein the melting temperature of the binding resin is 125° C.

3. The electrophotographic black toner of claim 1, wherein the amount of the wax added is 3 parts by weight with respect to 100 parts by weight of the binding resin.

4. An electrophotographic black toner comprising:

a binding resin made of a polyester resin having an acid value of 5 mgKOH/g, wherein the melting temperature of the binding resin is 125° C.;

a wax made of an alcohol-modified paraffin wax having an acid value of 2 or 20 mgKOH/g; and a coloring agent.

5. The electrophotographic black toner of claim 4, wherein the amount of the wax added is 3 parts by weight with respect to 100 parts by weight of the binding resin.

6. An electrophotographic color toner comprising:

a binding resin made of a polyester resin having an acid value of 5 mgKOH/g, wherein the melting temperature of the binding resin is 110° C.;

a wax made of an alcohol-modified paraffin wax having an acid value of 4 or 15 mgKOH/g; and a coloring agent.

7. The electrophotographic color toner of claim 6, wherein the DSC peak temperature of the wax is 85° C.

* * * * *